US007015642B2

(12) United States Patent
Gaber et al.

(10) Patent No.: US 7,015,642 B2
(45) **Date of Patent: *Mar. 21, 2006**

(54) LIGHT INTENSIFIER TUBE

(75) Inventors: Leonid Gaber, San Leandro, CA (US); Dmitry Naroditsky, San Francisco, CA (US); Marc Morgovsky, Foster City, CA (US); Dmitry Sokolov, Moscow (RU); Sergei Kuklev, Moscow (RU)

(73) Assignee: K.W. Muth Company, Inc., Sheboygan, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/029,886

(22) Filed: Jan. 4, 2005

(65) Prior Publication Data

US 2005/0116148 A1 Jun. 2, 2005

Related U.S. Application Data

(63) Continuation of application No. 10/060,899, filed on Jan. 29, 2002, now abandoned.

(51) Int. Cl.
*H01J 40/00* (2006.01)
*H01J 40/06* (2006.01)

(52) U.S. Cl. ..... 313/537; 313/542; 313/544

(58) Field of Classification Search ..... 313/524–532, 313/537, 540, 543, 544
See application file for complete search history.

(56) References Cited

U.S. PATENT DOCUMENTS 3,625,122 A 12/1971 Valdes
3,652,154 A 3/1972 Gebel
3,989,971 A 11/1976 Santilli et al.
4,355,229 A 10/1982 Zimmerman et al.
4,383,169 A 5/1983 Ashton
4,649,426 A 3/1987 Bolstad
4,937,442 A 6/1990 Carts, Jr. et al.
4,982,136 A 1/1991 Dolizy, deceased et al.
5,049,730 A 9/1991 Loveland
5,276,539 A 1/1994 Humphrey
5,396,069 A 3/1995 Craig et al.
5,519,209 A 5/1996 Rapoport et al.
5,579,165 A 11/1996 Michel et al.
5,682,229 A 10/1997 Wangler
5,729,010 A 3/1998 Pinkus et al.
5,870,180 A 2/1999 Wangler
5,903,996 A 5/1999 Morley
6,072,565 A 6/2000 Porter
6,142,637 A 11/2000 Cohen et al.
6,700,123 B1 * 3/2004 Musiel et al. ..... 250/330

OTHER PUBLICATIONS http://www.drev.dnd.ca/en/rechercha_sauvetage/rs-02/p.0201.asp, "ALBEDOS"—An Airborne Active Imaging System web pages pp. 1-3, printed Dec. 16, 2002.
http://www.daimlerchrysler.com/news/top/2000/100405$_{13}$ e_htm. "Improving Night Vision" web pages pp. 1-2, printed Feb. 6, 2002.

* cited by examiner

*Primary Examiner*—Joseph Williams
*Assistant Examiner*—Matt Hodges
(74) *Attorney, Agent, or Firm*—Wells St. John P.S.

(57) ABSTRACT

A light intensifier tube is described and which includes a photocathode; a luminescent screen disposed in spaced relation relative the photocathode; a shutter electrode disposed intermediate the photocathode and the luminescent screen; and an anode located intermediate the shutter electrode and the luminescent screen is provided.

10 Claims, 1 Drawing Sheet

LIGHT INTENSIFIER TUBE

CROSS REFERENCE TO RELATED APPLICATION

This is a continuation of U.S. patent application Ser. No. 10/060,899, filed Jan. 29, 2002 now abandoned, and titled "Light Intensifier Tube."

FIELD OF THE INVENTION

The present invention relates to vision enhancement devices, and more specifically to a light intensifier tube which is incorporated into such devices, and which includes a shutter electrode, and which finds usefulness for viewing objects in environments having on the one hand, low ambient light, or on the other hand, other conditions which prohibit the timely, and effective imaging of the objects.

DESCRIPTION OF THE PRIOR ART

The prior art is replete with numerous examples of prior art image intensifying devices and assorted assemblies which have been incorporated into devices such as night vision scopes, laser range finders and other similar devices which have been used in various civilian and military applications.

As a general matter, many of these devices have included a light intensifier tube which transforms electromagnetic radiation which may, in some cases, not be visibly perceivable by the human eye, and which may be in selected wavelengths such as infrared, ultraviolet, or x-ray, and convert this same electromagnetic radiation into a visible image which then may be utilized by an observer for various applications. Yet further, these same light intensifier tubes may be designed to take ambient, visibly discernable electromagnetic radiation, and thereafter amplify it to create a visibly perceivable image which may be used by an observer to see an object of interest under poor visibility conditions.

The prior art light intensifier tubes, as a general matter, normally include a photocathode; an image intensification system; an anode and a luminescent screen. In this regard the photocathode is operable to transform the electromagnetic radiation forming the original optical image into an electronic image. The image intensifying system in these prior art devices is operable to take the electronic image, amplify it and then transfer it to the luminescent screen, where this image is then converted into a visibly discernable image which may be perceived by the operator of same. In this arrangement, electromagnetic radiation originating from the object of interest, or from another source, upon impacting the photocathode causes a resulting emission of electrons in the form of a photocurrent from the surface of same. The resulting photoelectrons formed by this process are accelerated and focused by the light intensifier tube. The focused photoelectrons bombard the luminescent screen and cause it to luminesce. In order to focus the photoelectrons to produce good useable images, the various prior art devices have utilized magnetic fields of various types, and other electrostatic-type lenses which are located between the photocathode and the anode. The aforementioned lenses are operable to collect the electrons emitted from the photocathode surface into narrow beams which reproduce on the luminescent screen in a visibly discernible image which closely replicates or corresponds to the image projected on the photocathode.

While these earlier prior art light intensifier tubes have operated with varying degrees of success, numerous shortcomings in their individual designs have detracted from their usefulness.

For example it has been observed, that the optical resolution capacity of these earlier prior art light intensifier tubes was somewhat limited by aberrations in the electronic lenses employed with same. Still further, it was observed that it was quite difficult to reduce optical aberrations to allowable ranges by changing the resulting geometry of any of the electrodes employed in these assemblies. Consequently, in the decades following the development of these aforementioned prior art devices, sophisticated second and third generation light intensifier tubes were developed which included the use of assorted fiber-optical electrodes, and microchannel plates of various designs. While these so-called multiple-stage light intensifier tubes significantly increased the brightness of any resulting image, further difficulties remained with the use of such devices for imaging objects where other competing light sources might also be in the general vicinity of the object being observed. In this regard, other bright light sources in the vicinity of the object being viewed would often cause the resulting image provided to the observer to be completely unusable. This has been known as the so-called "Bloom Effect". Various schemes and devices have been developed to reduce the bloom effect and this is shown more clearly in various prior art references such as U.S. Pat. Nos. 5,396,069 and 5,519,209 to name but a few.

As might be expected, while these various improvements have resulted in second and even third generation light intensifier tubes having improved performance characteristics, these improvements have significantly increased the difficulty in manufacturing same, and the resulting cost of the more recent light intensifier tubes when incorporated into various devices have placed them virtually out of reach for use in many industrial and other civilian applications. Consequently, their use has been confined, to a large degree, to mostly military and other law enforcement applications.

Accordingly, light intensifier tube which achieves the benefits to be derived from the aforementioned technology, but which avoids the determents individually associated therewith, and which can be used in various devices which have civilian and other industrial applications to image objects of interest during reduced ambient lighting or other environmental conditions is the subject matter of the present invention.

SUMMARY OF THE INVENTION

A first aspect of the present invention relates to a light intensifier tube which includes a photocathode; a luminescent screen disposed in spaced relation relative to the photocathode; a shutter electrode disposed intermediate the photocathode and the luminescent screen; and an anode located intermediate the shutter electrode and the luminescent screen.

Another aspect of the present invention relates to a light intensifier tube which includes a shutter electrode having an integral body which comprises a first cylindrical portion and a second cylindrical portion, each of the cylindrical portions having a predetermined diametral dimension, and wherein the first cylindrical portion is located adjacent the photocathode and wherein the diametral dimension of the first cylindrical portion is less than the diametral dimension of the second cylindrical portion.

Another aspect of the present invention relates to a light intensifier tube having a shutter electrode which has a first operational condition which permits electromagnetic radiation to be processed by the light intensifier tube, and a second operational condition which substantially prevents electromagnetic radiation from being processed by the light intensifier tube, and wherein the shutter electrode is placed in the first condition for a predetermined duration of time, and wherein the duration of time is adjustable.

Another aspect of the present invention relates to a light intensifier tube which produces a visibly discernable light output from which information regarding an object of interest may be derived.

These and other aspects of the present invention will be discussed in greater detail hereinafter.

BRIEF DESCRIPTION OF THE DRAWINGS

Preferred embodiments of the invention are described below with reference to the following accompanying drawing.

FIG. 1 is a somewhat enlarged fragmentary, longitudinal, vertical sectional view taken through a light intensifier tube which finds usefulness in the present invention.

DETAILED DESCRIPTION OF THE PREFERRED EMBODIMENTS

Figure 11:
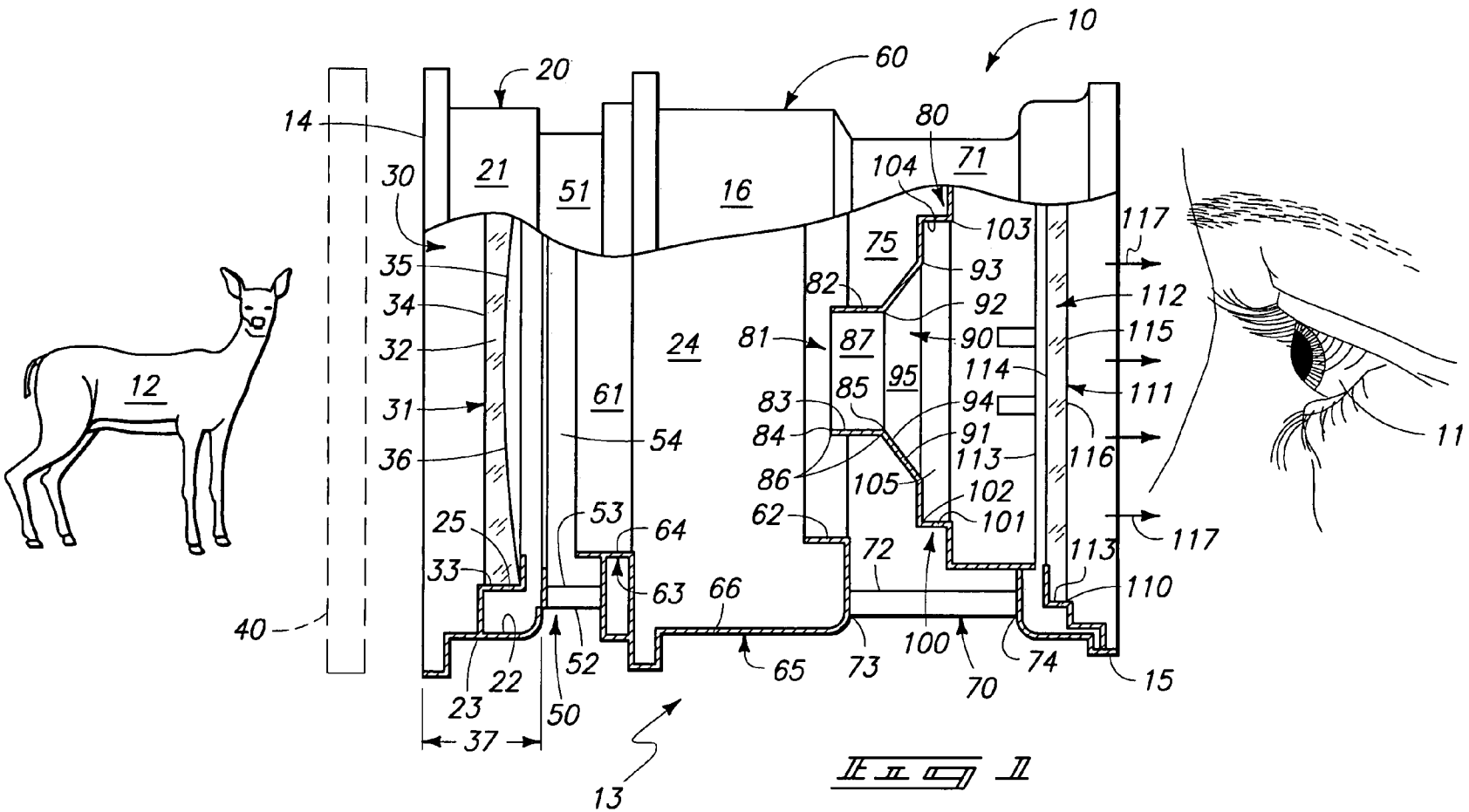

This disclosure of the invention is submitted in furtherance of the constitutional purposes of the U.S. Patent Laws "to promote the progress of science and useful arts" (Article 1, Section 8).

Referring now to FIG. 1, a light intensifier tube, which is generally indicated by the numeral 10 is shown, and which finds usefulness in various devices. As seen therein, the light intensifier tube is operable to be used by an observer 11. The observer 11 may utilize the light intensifier tube to see objects of interest such as the deer 12, during periods of low ambient light or under other environmental circumstances or weather conditions which would prevent or substantially impede the effective viewing of same.

The light intensifier tube 10 has a main body 13 with a first, target or object end 14; and an opposite, second, image or operator viewing end 15. The main body 13 is defined by an irregularly shaped peripheral surface having various outside diametral dimensions. The main body 13 includes a first or photocathode housing which is generally designated by the numeral 20, and which is defined by a substantially circumscribing wall 21 having an outside diametral dimension. The wall 21 has an inside facing surface 22, and an outside facing surface 23. The inside facing surface 22 defines, in part, a longitudinally extending passageway 24 which extends between the first end 14, and the opposite second end 15. As seen in FIG. 1 a circumscribing flange 25 is located at the first end 14, and which extends substantially radially, inwardly relative to the inside facing surface 22. The circumscribing flange is operable to support a photocathode which will be discussed in greater detail hereinafter.

The first housing 20 which operates to enclose, and support, a photocathode, which will be discussed below, defines at the first end 14 of the light intensifier tube 10, an aperture 30, having a given diametral dimension and which permits electromagnetic radiation originating from various sources, (whether reflected, or otherwise) to enter the main body 13. As seen in FIG. 1, a photocathode is provided, and which is generally indicated by the numeral 31. The photocathode 31 is supported in an appropriate substantially occluding orientation relative to the aperture 30. The photocathode is utilized to receive the various wavelengths of electromagnetic radiation and permit the electromagnetic radiation to pass into the main body 13 of the light intensifier tube 10. The photocathode 31 has a main body 32 which is defined by a peripheral edge 33 and which is matingly received in, and otherwise supported on, and by, the circumscribing flange 25 which is mounted at the first end 14. The main body 32 is fabricated from an appropriate, optically transmissive substrate which allows the passage of electromagnetic radiation of the wavelengths desired therethrough. The photocathode has an exterior facing surface 34 which generally faces outwardly towards the object of interest 12 and which further is substantially planar. Moreover the photocathode has an opposite, interior facing, and concavely shaped surface 35. As seen in FIG. 1, a thin coating 36 is applied to at least a portion of the interior facing surface 35. The thin film coating has a thickness of about 500 to about 1,000 Angstroms and is fabricated by way of chemical vapor deposition or physical vapor deposition from $SnO_2$; or $SnO_2$ in a mixture of from about 10 percent to about 20 percent $In_2O_2$. In order to achieve the optical resolution capacity, and the other desirable characteristics of the present invention, it has been discovered that the length of the first photocathode housing 21 should be in a range of from about 1 to about 2.8 millimeters as indicated by the line labeled 37. Still further, the surface area of the concavely shaped interior facing surface 35 is selected such that it results in a minimal electrical resistance of same. This results in an increasing speed of operation of the light intensifier tube 10, in a dynamic mode of operation. In certain applications, it may be desirable to select certain wavelength of electromagnetic radiation for processing by the light intensifier tube in order to increase its overall sensitivity. In this regard, it should be understood that certain optical filters such as indicated by numeral 40 may be provided and which are positioned adjacent the first end 14 and which selectively pass particular bands of electromagnetic radiation, such as infrared light.

The first photocathode housing 20 which receives or otherwise supports the photocathode 31 in an appropriate orientation is coupled or otherwise affixed to a first electrically insulative spacer which is generally indicated by the numeral 50. The first electrically insulative spacer has a generally annular shaped main body 51 which is defined by an outside facing surface 52 having an outside diametral dimension which is less than the outside diametral dimension of the photocathode housing 20; and an inside facing surface 53 which defines a passageway 54. The passageway 54 is substantially coaxially aligned with, and forms a portion of the passageway 24 which extends between the first and second ends 14 and 15 thereof. The first electrically insulative spacer ensures an appropriate spatial relationship between the photocathode 31, and the adjoining shutter electrode, or assembly which will be discussed in greater detail hereinafter. The first housing 20 is coupled to the first electrically insulative spacer 50 by means of metal-ceramic soldering or any other reliable fastening technique in order to sealably couple the photocathode to the electrically insulative spacer.

Referring still to FIG. 1 a shutter assembly or shutter electrode is generally indicated by the numeral 60 and which is physically coupled to the electrically insulative spacer 50 and spaced about 3 millimeters away from the photocathode 31. The shutter electrode 60 has a first end 61, and an opposite second end 62. Yet further, the earlier described passageway 24, extends substantially coaxially through the shutter electrode 60. The shutter electrode 60 has a first, substantially annular shaped portion 63 which is defined by an inside facing surface 64. The first portion has a first inside diametral dimension which is about 12.5 millimeters. Still further, the length of the first portion 63 of the shutter electrode 60 is preferably in a range of about 2 to about 6.5 millimeters. As seen in the drawing, a part of the first portion 63 is telescopingly received within the passageway defined by the first electrically insulative spacer 50. Made integral with, and substantially coaxially aligned relative to the first portion 63, is a second portion 65 which is defined by an inside facing surface 66. The inside facing surface of the second portion defines an inside diametral dimension which is greater than the inside diametral dimension of the first portion 63. The second portion has an outside diametral dimension which is greater than the outside diametral dimension of the electrically insulative spacer 50. The shutter electrode 60 is electrically coupled with a controller and other control circuitry (not shown) and which permits the shutter electrode, to alternatively assume or rapidly electrically switch between two different operating conditions or states, that is, a first operating condition, and a second operating condition. In the first operating condition electromagnetic radiation forming an optical image passes through the shutter electrode 60 and along the passageway 24 where it is amplified to provide a visibly discernible light output at the second end 15. Further in the second operating condition, the shutter electrode substantially impedes the amplification of any electromagnetic radiation passing through the light intensifier tube 10. The length of the second portion 65 of the shutter electrode 60 is about 12 millimeters to about 18 millimeters. As seen in FIG. 1 the first and second portions 63 and 65 are made substantially integral one with the other.

Still referring to FIG. 1, the light intensifier tube 10, of the present invention, includes a second electrically insulative spacer which is generally indicated by the numeral 70, and which is disposed in substantially coaxial alignment relative to the shutter electrode 60. As seen, the second electrically insulative spacer 70 is substantially annularly shaped and is physically coupled to the second portion 65. In this regard, the second electrically insulative spacer 70 has an outside peripheral surface 71, defining an outside diametral dimension which is less than the outside diametral dimension of the second portion 65 of the shutter electrode 60, and an opposite inside facing surface 72 which has a given inside diametral dimension. Yet further, the second electrically insulative spacer has a first end 73 which is suitably coupled, by an appropriate fastening technique, to the second portion 65; and an opposite second end 74 which is spaced therefrom. The second electrically insulative spacer 70 defines a passageway 75 which forms a portion of the passageway 24.

Referring still to FIG. 1 an anode is generally indicated by the numeral 80 and is located intermediate the shutter electrode 60 and the second end 15. In this regard the anode 80 is specially dimensioned, as will be discussed hereinafter, to provide some of the features of the present invention. In this regard the anode 80 has a first portion 81, having a main body 82 and which is substantially annular in shape. The main body 82 has an inside facing surface 83 which defines an aperture having a given inside diametral dimension. The first portion 81 has a first end 84, and a second end 85. Yet further, the main body 82 has a length dimension indicated by the line labeled 86 of about 4.85 millimeters. A passageway 87 is defined by the inside facing surface 83 and is substantially coaxially aligned with the passageway 24. The first portion of the anode is telescopingly received, in part, within the passageway defined by the second portion 65 of the shutter electrode. Still further, the remaining part of the first portion of the anode 81 is telescopingly received within the passageway 75 which is defined by the second electrically insulative spacer 70.

As seen in FIG. 1, the anode 80 has a second portion 90 having a main body 91. The main body has a first end 92 forming an aperture having an inside diametral dimension substantially identical to the inside diametral dimension as defined by the first portion 81. Yet further, the main body 91 has a second end 93 which has a second diametral dimension which is greater than the first end. The main body 91 therefore has a substantially frusto-conical shape. The main body 91 has an inside facing surface 94 which defines a passageway 95 which is substantially coaxially aligned with the passageway 24. The anode 80 also includes a third portion which is generally indicated by the numeral 100. The third portion has a main body 101 having opposite first and second ends 102 and 103, respectively. As seen, the main body 101 has an inside facing surface 104 which defines an inside diametral dimension. The inside facing surface 104 defines a passageway 105 which is substantially coaxially aligned with the passageway 24. The inside diametral dimension of the third portion of the anode 80 is about 22.26 millimeters. The anode 80 and the specific spatial relationships between the diameters and the lengths of the individual portions are selected so as to make it possible for the light intensifier tube 10 to achieve an optical resolution of about 50 to 75 lines per millimeter when the object detection apparatus of the present invention is operating in a pulsed mode of operation. In particular, the aforementioned optical resolution of the light intensifier tube 10 along with the minimal capacitance of the shutter electrode 60 and the accompanying photocathode 31 causes the cycling time between the first and second operating conditions of the shutter electrode to be decreased to periods of time as little as 5 nanoseconds.

Referring still to FIG. 1, a circumscribing flange 110 is provided at the second end 15 and which defines an aperture having a given a diametral dimension. The circumscribing flange supports a luminescent screen which is generally indicated by the numeral 111, and which further substantially occludes the aperture. The luminescent screen 111 is fabricated from an optically transmissive substrate 112 which is defined by a peripheral edge 113. The peripheral edge 113 rests in mating relation relative to the circumscribing flange 110. Yet further, the optically transmissive substrate 112 has a first inside facing surface 114, and a second outside facing surface 115. A luminescent coating 116 is deposited using techniques well known in the art on the outside facing surface. It should be understood, that the light intensifier tube 10 is operable, when placed in the first operating condition, to amplify electromagnetic radiation entering at the first end 14 and provide a visibly discernable light output 117.

Operation

The operation of the described embodiment of the present invention is believed to be readily apparent and is briefly summarized at this point.

In it's broadest aspect the light intensifier tube 10 of the present invention includes a main body 13 having a shutter electrode 60 which has a first, operational condition which permits electromagnetic radiation forming an optical image to be processed by the light intensifier tube; and a second operational condition which substantially prevents the electromagnetic radiation from being processed by the light intensifier tube 10. The shutter electrode 60 is placed in the first open condition for a predetermined duration of time. This duration of time is adjustable.

Yet further the light intensifier tube of the present invention more specifically includes a photocathode 31; a luminescent screen 111 which is disposed in spaced relation relative to the photocathode; a shutter electrode 60 disposed intermediate the photocathode and the luminescent screen; and an anode 80 located intermediate the shutter electrode and the luminescent screen.

In particular, the light intensifier tube of the present invention includes a main body 13 having opposite first and second ends 14 and 15, and which defines a substantially longitudinally extending passageway 24 extending between the first and second ends thereof. A photocathode housing 20 is provided and which forms a portion of the main body 13 and which is oriented at the first end 14 thereof. The photocathode housing 20 has a peripheral surface 21 which defines an outside diametral dimension and which further defines an aperture 30 at the first end of the main body. The photocathode housing 20 has a length dimension 37 of about 1 to about 2.8 millimeters and is further substantially electrically isolated relative to the remaining portion of the main body. A photocathode 31 is provided and disposed in substantially occluding relation relative to the aperture 30 and which is defined by the photocathode housing 20. The photocathode 31 has a main body 32 which is fabricated from an optically transmissive substrate with a substantially planar outside facing surface 34, and a substantially concavely shaped inside facing surface 35. A surface coating 36 consisting essentially of $SnO_2$, and mixtures thereof, is applied over at least a portion of the inside substantially concavely shaped surface of the photocathode 35.

A first electrically insulative spacer 50 is mounted on the photocathode housing 20 and defines a passageway 54. The first electrically insulative spacer 50 has an outside facing surface 51 defining an outside diametral dimension, which is less than the outside diametral dimension of the photocathode housing 20. A shutter electrode 60 is disposed intermediate the first and second ends 14 and 15 of the main body 13. The shutter electrode 60 has first and second portions 63, and 65 and which are made integral one with the other, and which are substantially electrically isolated from the remaining portions of the main body 13. The first portion 63 of the shutter electrode is spaced about 3 millimeters from the photocathode 31. Still further, the first portion 63 defines a passageway having an inside diametral dimension of about 12.5 millimeters and a length dimension of about 2 to about 6.5 millimeters. As seen in FIG. 1, at least a part of the first portion 63 of the shutter electrode 60 is substantially telescopingly received within the passageway 54 which is defined by the first electrically insulative spacer 50. The second portion 65 defines a passageway having an inside diametral dimension greater than a diametral dimension of the passageway defined by the first portion 63. The second portion 65 has a length dimension of about 12 to 18 millimeters. The second portion of the shutter electrode 60 has an outside diametral dimension greater than the outside diametral dimension of the first electrically insulative spacer 50.

A second electrically insulative spacer 70 is provided, and mounted on the second portion 65 of the shutter electrode 60. This second electrically insulative spacer has an outside peripheral surface 71 defining an outside diametral dimension which is less than the outside diametral dimension of the second portion 65 of the shutter electrode 60. The second electrically insulative spacer 70 has an inside facing surface 72 and which defines a passageway 75 having an inside diametral dimension, and which forms a part of, and is substantially coaxially aligned relative to, the passageway 24 which extends between the first and second ends 14 and 15 of the main body 13.

An anode 80 is disposed intermediate the shutter electrode 60 and the second end 15 of the main body 13. The anode has first, second and third portions 81, 90 and 100, respectively, and which are made integral one with the other, and which are substantially electrically isolated from the remaining portions of the main body 13. The first portion 81 defines a passageway 87 having a inside diametral dimension and a length dimension of about 2 to about 6.5 millimeters. As seen in FIG. 1, at least a part of the first portion 81 is telescopingly received within the passageway defined by the second portion 65 of the shutter electrode 60. Still further, any remaining part of the first portion 81 is telescopingly received within the passageway 75 which is defined by the second electrically insulative spacer 70. The third portion 100 is made integral with the second portion 90 and defines a passageway having an inside diametral dimension greater than the inside diametral dimensions of both the first and second portions of the anode 80. As seen, a part of the third portion 100 is telescopingly received within the passageway 75 formed by the second electrically insulative spacer 70. Finally, a luminescent screen 111 is provided and which is disposed at the second end 15 of the main body 13 and in adjacent spaced relation relative to the anode 80 and which provides a visibly discernible light output 117.

The present light intensifier tube 10 provides numerous advantages over the prior art techniques and teachings including the substantial minimization of any "Bloom Effect" that may result from any reflected or other direct light sources which may be located within an area of interest which is being viewed by the observer 11. Still further, the simplicity of construction of the light intensifier tube 10 renders the present device useful for many civilian and other industrial applications.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A light intensifier tube, comprising:

a main body having opposite first and second ends, and further having a shutter electrode which has a first operational condition which permits electromagnetic radiation forming an optical image to be processed and amplified by the light intensifier tube, and a second operational condition which substantially prevents the electromagnetic radiation from being processed and amplified by the light intensifier tube; and means for rapidly cycling between the first and second operational conditions to produce a visibly discernable image on a luminescent screen, and wherein the means for rapidly cycling the shutter electrode is adjustable and is further located intermediate the first and second ends thereof, and wherein the light intensifier tube produces a visibly discernible light output which is provided at the second end thereof, and wherein the means for cycling the shutter electrode adjustably cycles the shutter electrode between the first and second operational conditions during a period of time as little as 5 nanoseconds, and wherein the visibly discernable image produced by the light intensifier tube on the luminescent screen has an optical resolution of about 50 lines per millimeter to about 75 lines per millimeter.

2. A light intensifier tube as claimed in claim 1, and further comprising:

a photocathode having a substantially planar outside facing surface; and wherein the luminescent screen is disposed in spaced relation relative to the photocathode; and wherein the shutter electrode is disposed intermediate the photocathode and the luminescent screen; and an anode is located intermediate the shutter electrode and the luminescent screen; and wherein an electrically insulative spacer defining a passageway is positioned therebetween the photocathode and the shutter electrode, and wherein a portion of the shutter electrode is received in the passageway which is defined by the insulative spacer.

3. A light intensifier tube comprising:

a photocathode having a substantially planar outside facing surface;

a photocathode housing defining a passageway, and wherein the photocathode substantially occludes the passageway, and wherein the photocathode housing has a length dimension of about 1 to about 2.8 millimeters;

a luminescent screen disposed in spaced relation relative to the photocathode;

a shutter electrode disposed intermediate the photocathode and the luminescent screen;

means for cycling the shutter electrode between a first operational condition where a first source of light having a first luminous intensity enters into the light intensifier tube and is amplified to form a discernable image on the luminescent screen, and a second operational condition, which substantially impedes the amplification of the first source of light; and an anode located intermediate the shutter electrode and the luminescent screen, and wherein the means for cycling the shutter electrode cycles the shutter electrode between the first and second operational conditions at a speed so as to form the discernible image on the luminescent screen, and substantially impedes the discernible image from being obliterated when a second source of light having a greater luminous intensity than the first source of light enters the light intensifier tube during the first operational condition.

4. A light intensifier tube as claimed in claim 3, and wherein the photocathode has an opposite, substantially concavely shaped, inside facing surface, and wherein a coating of $SnO_2$, or mixtures containing $SnO_2$, is deposited on at least a portion of the inside facing surface to a thickness of about 500 to about 1000 Angstroms.

5. A light intensifier tube as claimed in claim 4, and further comprising:

a first electrically insulative spacer disposed intermediate the photocathode housing and the shutter electrode, and which further defines a passageway, and wherein the photocathode is located about 3 millimeters from the shutter electrode, and wherein the shutter electrode has a first end which is telescopingly received within the passageway which is defined by the first electrically insulative spacer.

6. A light intensifier tube as claimed in claim 5, and further comprising:

a second electrically insulative spacer disposed intermediate the shutter electrode and the anode, and wherein the shutter electrode defines a passageway, and wherein the second electrically insulative spacer further defines a passageway and wherein the anode has a first and second portion, and the first portion of the anode has a first end which is telescopingly received within the passageway defined by the shutter electrode, and wherein the second portion of the anode is received within the passageway defined by the second electrically insulative spacer.

7. A light intensifier tube as claimed in claim 6, and wherein the first portion of the shutter electrode has a substantially annular shaped main body which defines the passageway, and wherein the passageway has an inside diametral dimension of about 12.5 millimeters; and wherein the second portion of the shutter electrode is made integral with the first portion, and has a passageway defined by an inside diametral dimension which is greater than that of the first portion, and wherein the first portion has a length dimension of about 2 millimeters to about 6.5 millimeters, and wherein the second portion has a length dimension of about 12 millimeters to about 18 millimeters.

8. A light intensifier tube for forming a discernible image under variable lighting conditions, comprising:

a photocathode housing defining a passageway and which has a length dimension of about 1 millimeter to about 2.8 millimeters;

a photocathode disposed in substantially occluding relation relative to the passageway of the photocathode housing, and wherein the photocathode has a main body with a first substantially planar outside facing surface, and a second, opposite, substantially concavely shaped inside facing surface;

a coating of $SnO_2$ or mixtures containing $SnO_2$, disposed in at least partial covering relation on the second surface of the photocathode, and wherein the coating has a thickness of about 500 to about 1000 Angstroms;

a first electrically insulative spacer mounted on the photocathode housing and which defines a passageway which is substantially coaxially aligned with the passageway defined by the photocathode housing;

a shutter electrode having a first portion with a first end which is mounted on the first electrically insulative spacer and which defines a passageway having an inside diametral dimension, and wherein the first end of the first portion is received in the passageway which is defined by the first electrically insulative spacer, and wherein the first portion has a length dimension of about 2 millimeters to about 6.5 millimeters, and wherein the shutter electrode is located about 3 millimeters from the photocathode and the inside diametral dimension of the first portion is about 12.5 millimeters; and a second portion, made integral with the first portion, and which defines a passageway having an inside diametral dimension greater than the first portion, and which has a length dimension of about 12 to about 18 millimeters;

a second electrically insulative spacer mounted on the second portion of the shutter electrode and which defines a passageway therethrough;

an anode mounted on and wholly positioned within the passageway which is defined by the second electrically insulative spacer;

a luminescent screen disposed adjacent the anode; and means for cycling the shutter electrode between a first and second operating condition, and wherein in the first operating condition, and when exposed to a first source of light having a first luminous intensity, the means for cycling causes the light intensifier tube to process and amplify electromagnetic radiation forming an optical image and which was derived from the first source of light to produce a visibly discernable image on the luminescent screen, and wherein in the second operating condition, the means for cycling the shutter electrode substantially prevents the electromagnetic radiation forming the optical image from being processed and amplified, and wherein the shutter electrode is rapidly cycled by the cycling means between the first and second operating conditions so as to produce a visibly discernable image on the luminescent screen when exposed simultaneously to the first source of light and a second sources of light which has a greater luminous intensity than the first source of light.

9. A light intensifier tube, comprising:

a main body having opposite first and second ends, and which defines a substantially longitudinally extending passageway extending between the first and second ends thereof;

a photocathode housing forming a portion of the main body and which is oriented at the first end thereof, and wherein the photocathode housing has a peripheral surface which defines an outside diametral dimension and which further defines an aperture at the first end of the main body, and wherein the photocathode housing has a length dimension of about 1 to about 2.8 millimeters and is further substantially electrically isolated relative to the remaining portion of the main body;

a photocathode disposed in substantially occluding relation relative to the aperture defined by the photocathode housing, and wherein the photocathode has a main body fabricated from an optically transmissive substrate with a substantially planar outside facing surface, and a substantially concavely shaped inside facing surface;

a surface coating consisting essentially of $SnO_2$ and mixtures of $SnO_2$ applied over at least a portion of the inside substantially concavely shaped surface of the photocathode;

a first electrically insulative spacer mounted on the photocathode housing and defining a passageway which forms a portion of the passageway defined by the main body, and wherein the first electrically insulative spacer has an outside facing surface defining an outside diametral dimension, and wherein the outside diametral dimension is less than the outside diametral dimension of the photocathode housing;

a shutter electrode disposed intermediate the first and second ends of the main body, and wherein the shutter electrode has first and second portions which are made integral one with the other, and which are substantially electrically isolated from the remaining portions of the main body, and wherein the first portion of the shutter electrode is spaced about 3 millimeters from the photocathode, and further defines a passageway having an inside diametral dimension of about 12.5 millimeters and a length dimension of about 2 to about 6.5 millimeters, and wherein at least a part of the first portion is substantially telescopingly received within the passageway defined by the first electrically insulative spacer, and wherein the second portion defines a passageway having an inside diametral dimension greater than the diametral dimension of the passageway defined by the first portion, and further has a length dimension of about 12 to 18 millimeters, and wherein the second portion of the shutter electrode has an outside diametral dimension greater than the outside diametral dimension of the first electrically insulative spacer;

a second electrically insulative spacer mounted on the second portion of the shutter electrode and which has an outside peripheral surface defining an outside diametral dimension, and an opposite inside facing surface and which defines a passageway having an inside diametral dimension, and which forms a part of, and is substantially coaxially aligned relative to, the passageway which extends between the first and second ends of the main body;

an anode disposed intermediate the shutter electrode and the second end of the main body, and wherein the anode has first, second and third portions which are made integral one with the others, and wherein the first portion defines a passageway having a inside diametral dimension and a length dimension of about 2 to about 6.5 millimeters, and wherein at least a part of the first portion is telescopingly received within the passageway defined by the second portion of the shutter electrode, and any remaining part of the first portion is telescopingly received within the passageway defined by the second electrically insulative spacer, and wherein the second portion is substantially frustoconically shaped and which defines a passageway which is substantially coaxially aligned with the first portion of the anode, and which further is telescopingly received within the passageway defined by the second electrically insulative spacer, and wherein the third portion is made integral with the second portion, and defines a passageway having an inside diametral dimension greater than the inside diametral dimensions of both the first and second portions of the anode, and wherein a part of the third portion is telescopingly received within the passageway formed by the second electrically insulative spacer;

a luminescent screen disposed at the second end of the main body and in adjacent spaced relation relative to the anode and which provides a visibly discernible light output; and means for cycling the shutter electrode rapidly between a first operational condition which permits light of varying luminous intensities and which originates from a plurality of sources to enter the light intensifier tube, and be amplified to produce a visibly discernable image, and a second operational condition which substantially impedes the amplification of the light, and wherein the speed of the cycling between the first and second operational conditions is selected so as to produce a discernible image on the luminescent screen notwithstanding that the light sources received by the light intensifier tube have widely variable luminous intensities, and wherein the size of the photocathode housing, shutter electrode, and anode are selected so as to produce a discernible image having an optical resolution of about 50 to about 75 lines per millimeter, and wherein the shutter electrode may be cycled between the first and second operating conditions during periods of time of at least about 5 nanoseconds.

10. A light intensifier tube, comprising:

a photocathode;

a luminescent screen;

a shutter electrode positioned intermediate the photocathode, and the luminescent screen, and wherein the shutter electrode has first and second operational conditions; and means for adjustably cycling the shutter electrode between the first operational condition, which permits visibly discernable light forming an optical image to be processed and amplified by the light intensifier tube to produce a discernable image having an optical resolution of greater than about 50 lines per millimeter on the luminescent screen, and the second operational condition wherein the light intensifier tube does not substantially amplify the visibly discernable light forming the optical image, and wherein the means for adjustably cycling cycles the shutter electrode between the first and second operational conditions during a period of time which may be as fast as 5 nanoseconds to produce a visibly discernable image while the light intensifier tube is being simultaneously exposed to multiple sources of visibly discernable light.

* * * * *